US008567924B2

(12) United States Patent
Gerner et al.

(10) Patent No.: US 8,567,924 B2
(45) Date of Patent: Oct. 29, 2013

(54) PATTERNED CONDUCTIVE ARRAY AND SELF LEVELING EPOXY

(75) Inventors: Bradley J. Gerner, Penfield, NY (US); Bryan R. Dolan, Rochester, NY (US); John R. Andrews, Fairport, NY (US); Peter J. Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 141 days.

(21) Appl. No.: 13/081,584

(22) Filed: Apr. 7, 2011

(65) Prior Publication Data

US 2012/0256990 A1 Oct. 11, 2012

(51) Int. Cl.
*B41J 2/045* (2006.01)

(52) U.S. Cl.
USPC ..... 347/70

(58) Field of Classification Search
USPC ..... 347/70; 29/25.35, 890.1
See application file for complete search history.

(56) References Cited

U.S. PATENT DOCUMENTS 4,425,382 A * 1/1984 Tajima ..... 427/203
2006/0044361 A1* 3/2006 Sugahara ..... 347/70
2008/0239022 A1 10/2008 Andrews et al.

OTHER PUBLICATIONS

Dolan et al., "Polymer Layer Removal of PZT Arrays a Using Plasma Etch", U.S. Appl. No. 13/011,409, filed Jan. 21, 2011.

* cited by examiner

*Primary Examiner* — Lisa M Solomon
(74) *Attorney, Agent, or Firm* — MH2 Technology Law Group LLP

(57) ABSTRACT

A method for forming an ink jet print head can include attaching a plurality of piezoelectric elements to a diaphragm, dispensing an interstitial layer over the diaphragm, electrically coupling a plurality of conductive elements to the plurality of piezoelectric elements, and curing the interstitial layer. A plurality of electrically isolated conductive particles within the interstitial layer electrically couple the plurality of conductive elements to the plurality of piezoelectric elements. The conductive particles can be evenly distributed throughout the totality of the interstitial layer dielectric, or they can be localized over a top surface of each piezoelectric element and interposed between the plurality of piezoelectric elements and the plurality of conductive elements. The conductive elements can be part of a flex circuit or printed circuit board.

6 Claims, 9 Drawing Sheets

PATTERNED CONDUCTIVE ARRAY AND SELF LEVELING EPOXY

FIELD OF THE INVENTION

The present teachings relate to the field of ink jet printing devices and, more particularly, to a high density piezoelectric ink jet print head and methods of making a high density piezoelectric ink jet print head and a printer including a high density piezoelectric ink jet print head.

BACKGROUND OF THE INVENTION

Drop on demand ink jet technology is widely used in the printing industry. Printers using drop on demand ink jet technology can use either thermal ink jet technology or piezoelectric technology. Even piezoelectric ink jet devices are more expensive to manufacture than thermal ink jet devices, piezoelectric ink jets are generally favored as they can use a wider variety of inks.

Piezoelectric ink jet print heads typically include a flexible diaphragm and a piezoelectric element attached to the diaphragm. When a voltage waveform is applied to the piezoelectric element, typically through electrical connection with an electrode electrically coupled to a voltage source, the piezoelectric element oscillates, causing the diaphragm to oscillate. Consequently, this will expel a quantity of ink from a chamber through a nozzle. The oscillation further draws ink into the chamber from a main ink reservoir through an opening to replace the expelled ink.

Increasing the printing resolution of an ink jet printer employing piezoelectric ink jet technology is a goal of design engineers. Increasing the jet density of the piezoelectric ink jet print head can increase printing resolution. One way to increase the jet density is to eliminate manifolds which are internal to a jet stack. With this design, it is preferable to have a single port through the back of the jet stack for each jet. The port functions as a pathway for the transfer of ink from the reservoir to each jet chamber. Because of the large number of jets in a high density print head, the ink inlets must pass vertically through the diaphragm and between the piezoelectric elements.

Manufacturing a high density ink jet print head assembly having an external manifold has required new processing methods. Piezoelectric ink jet print heads with an external manifold require ink inlets to pass through the electronic portion of the print head assembly. Assembly methods for a print head having an electrical interconnect layer that is easier to manufacture than prior assemblies would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for forming an ink jet print head, including attaching a plurality of piezoelectric elements to a diaphragm, dispensing an interstitial layer comprising a dielectric to encapsulate the plurality of piezoelectric elements and to contact the diaphragm, attaching a plurality of conductive elements to a top surface of the interstitial layer, wherein a plurality of conductive particles within the interstitial layer dielectric electrically couples the plurality of conductive elements to the plurality of piezoelectric elements, and curing the interstitial layer.

In another embodiment, an ink jet print head can include a diaphragm comprising a plurality of openings therethrough, a body plate attached to the diaphragm with a diaphragm attach material, a plurality of piezoelectric elements attached to the diaphragm, and an interstitial layer encapsulating the plurality of piezoelectric elements. The ink jet print head can further include a plurality of conductive elements and a plurality of conductive particles interposed between each conductive element and each piezoelectric element, wherein the plurality of conductive particles are dispersed within the interstitial layer, are electrically isolated from each other, and electrically couple the plurality of piezoelectric elements to the plurality of conductive elements.

An embodiment of the present teachings can further include a printer having an ink jet print head which includes a diaphragm comprising a plurality of openings therethrough, a body plate attached to the diaphragm with a diaphragm attach material, a plurality of piezoelectric elements attached to the diaphragm, an interstitial layer encapsulating the plurality of piezoelectric elements, and a flex circuit comprising a plurality of conductive elements. The printer can further include a plurality of conductive particles interposed between each conductive element and each piezoelectric element, wherein the plurality of conductive particles are dispersed within the interstitial layer, are electrically isolated from each other, and electrically couple the plurality of piezoelectric elements to the plurality of conductive elements, a manifold attached to the flex circuit, and an ink reservoir formed by a surface of the manifold and a surface of the flex circuit.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
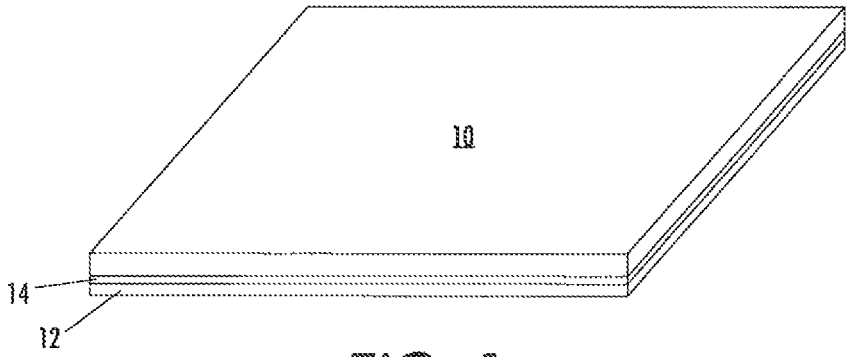
FIGS. 1 and 2 are perspective views of intermediate piezoelectric elements of an in-process device in accordance with an embodiment of the present teachings.

It should be noted that some details of the FIGS. have been simplified and are drawn to facilitate understanding of the inventive embodiments rather than to maintain strict structural accuracy, detail, and scale.

DESCRIPTION OF THE EMBODIMENTS

Reference will now be made in detail to embodiments of the present teachings, an example of which is illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "polymer" encompasses any one of a broad range of carbon-based compounds formed from long-chain molecules including thermoset polyimides, thermoplastics, resins, polycarbonates, epoxies, and related compounds known to the art.

Embodiments of the present teachings can simplify the manufacture of a jet stack for a print head, which can be used as part of a printer. The present teachings can include the use of an anisotropic conductive epoxy, which is a material that is an electrical conductor in the z-axis and a nonconductor in the x-axis and the y-axis. Other embodiments can include the use of a localized z-axis conductor. In some prior processes, an electrically nonconductive interstitial layer formed between adjacent piezoelectric elements (i.e., transducers) was formed over the top surface of the plurality of piezoelectric elements, and had to be removed from the top piezoelectric element surface to facilitate electrical communication with a printed circuit board (PCB) electrode. Removal of the overlying interstitial layer would require the use of an etch mask and an etching process. In an embodiment of the proposed process, the interstitial layer would function as both a standoff layer to provide large area adhesion and electrical connection to the PCB electrodes and the piezoelectric elements. In another embodiment, the interstitial layer epoxy over the top of the piezoelectric elements has conductive elements placed selectively over the tops of each of the piezoelectric elements. This can be accomplished using a stencil or mask that would later be removed.

The formation and use of a print head is discussed in U.S. patent Ser. No. 13/011,409, titled "Polymer Layer Removal on PZT Arrays Using A Plasma Etch," filed Jan. 21, 2011, which is incorporated herein by reference in its entirety. The present teachings can form the interstitial layer without the requirement for a patterned etch of the interstitial layer covering the top surface of the piezoelectric elements, and without forming a patterned standoff layer to provide large area adhesion to the electronic interface.

An embodiment of the present teachings can include the formation of a jet stack, a print head, and a printer including the print head. In the perspective view of FIG. 1, a piezoelectric element layer 10 is detachably bonded to a transfer carrier 12 with an adhesive 14. The piezoelectric element layer 10 can include, for example, a lead-zirconate-titanate layer, for example between about 25 μm to about 150 μm thick to function as an inner dielectric. The piezoelectric element layer 10 can be plated on both sides with nickel, for example, using an electroless plating process to provide conductive layers on each side of the dielectric PZT. The nickel-plated PZT functions essentially as a parallel plate capacitor which develops a difference in voltage potential across the inner PZT material. The carrier 12 can include a metal sheet, a plastic sheet, or another transfer carrier. The adhesive layer 14 which attaches the piezoelectric element layer 10 to the transfer carrier 12 can include a dicing tape, thermoplastic, or another adhesive. In another embodiment, the transfer carrier 12 can be a material such as a self-adhesive thermoplastic layer such that a separate adhesive layer 14 is not required.

Figure 2:
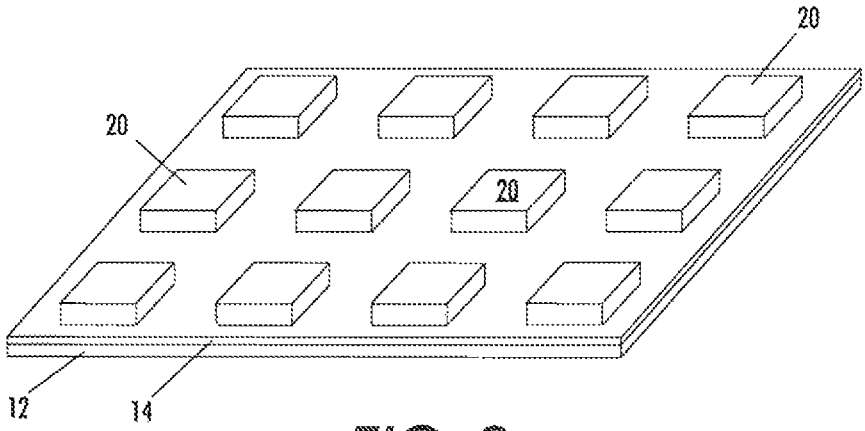

After forming the FIG. 1 structure, the piezoelectric element layer 10 is diced to form a plurality of individual piezoelectric elements 20 as depicted in FIG. 2. It will be appreciated that while FIG. 2 depicts 4×3 array of piezoelectric elements, a larger array can be formed. For example, current print heads can have a 344×20 array of piezoelectric elements. The dicing can be performed using mechanical techniques such as with a saw such as a wafer dicing saw, using a dry etching process, using a laser cutting process, etc. To ensure complete separation of each adjacent piezoelectric element 20, the dicing process can terminate after removing a portion of the adhesive 14 and stopping on the transfer carrier 12, or after dicing through the adhesive 14 and into the carrier 12.

Figure 3:
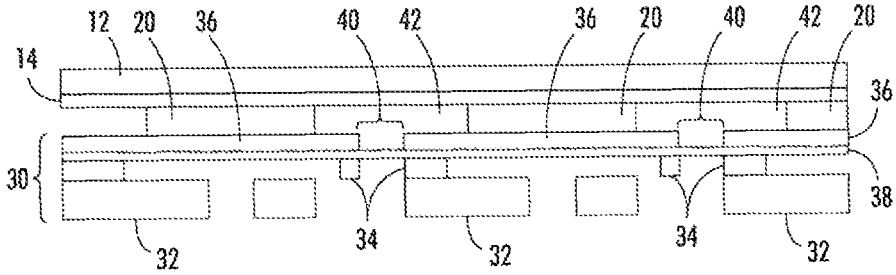
FIGS. 3-9 are cross sections depicting the formation of a jet stack for an ink jet print head.

After forming the individual piezoelectric elements 20, the FIG. 2 assembly can be attached to a jet stack subassembly 30 as depicted in the cross section of FIG. 3. The FIG. 3 cross section is magnified from the FIG. 2 structure for improved detail, and depicts cross sections of one partial and two complete piezoelectric elements 20. The jet stack subassembly 30 can be manufactured using known techniques. The jet stack subassembly 30 can include, for example, an inlet/outlet plate 32, a body plate 34, and a diaphragm 36 which is attached to the body plate 34 using an adhesive diaphragm attach material 38. The diaphragm 36 can include a plurality of openings 40 for the passage of ink in the completed device as described below. The FIG. 3 structure further includes a plurality of voids 42 which, at this point in the process, can be filled with ambient air. The diaphragm attach material 38 can be a solid sheet of material such as a single sheet polymer so that the openings 40 through the diaphragm 36 are covered.

In an embodiment, the FIG. 2 structure can be attached to the jet stack subassembly 30 using an adhesive between the diaphragm 36 and the piezoelectric elements 20. For example, a measured quantity of adhesive (not individually depicted) can be dispensed, screen printed, rolled, etc. onto either the upper surface of the piezoelectric elements 20, onto the diaphragm 36, or both. In an embodiment, a single drop of adhesive can be placed onto the diaphragm for each individual piezoelectric element 20. After applying the adhesive, the jet stack subassembly 30 and the piezoelectric elements 20 are aligned with each other, then the piezoelectric elements 20 are mechanically connected to the diaphragm 36 with the adhesive. The adhesive is cured by techniques appropriate for the adhesive to result in the FIG. 3 structure.

Subsequently, the transfer carrier 12 and the adhesive 14 are removed from the FIG. 3 structure to result in the structure of FIG. 4.

Figure 4:
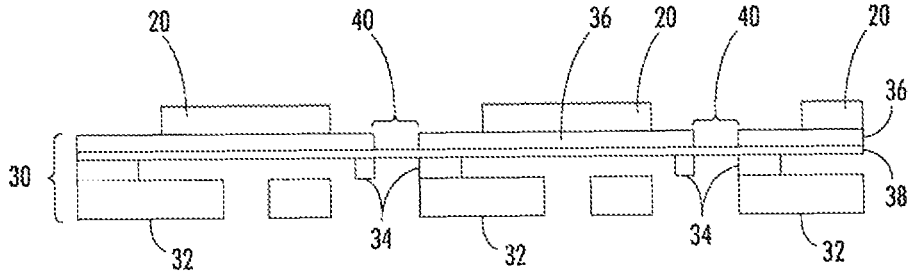
Figure 5:
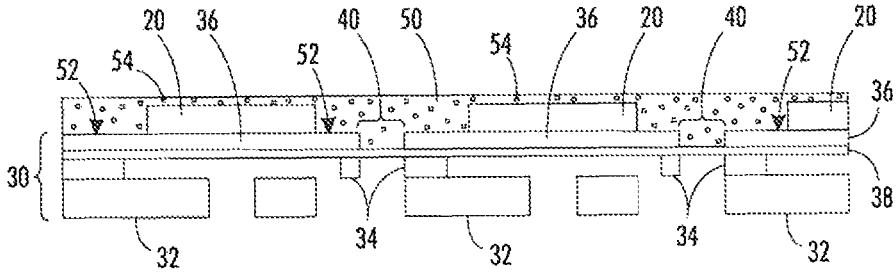

Next, an interstitial fill material is dispensed over the FIG. 4 structure to provide an interstitial layer 50 between each of the piezoelectric elements 20, and over the top surface of each piezoelectric element 20 as depicted in FIG. 5. In this embodiment, the interstitial fill material can include conductive balls or conductive particles within a dielectric, which provides a conductor in the z-axis and an insulator in the x-axis and the y-axis. A material which would function sufficiently is 125-22 anisotropic conductive epoxy adhesive available from Creative Materials, Inc. of Tyngsboro, Mass. Other materials such as conductor-filled liquids, pastes, and epoxies would function sufficiently, and such materials suitable for use as the interstitial layer 50 of embodiments of the present teachings are collectively referred to herein as anisotropic conductive fillers. The anisotropic conductive filler can be dispensed in a quantity sufficient to cover exposed portions of an upper surface 52 of the diaphragm 36 and to encapsulate the piezoelectric elements 20 as depicted in FIG. 5. The anisotropic conductive filler can further fill the openings 40 within the diaphragm 36 as depicted. The diaphragm attach material 38 which covers openings 40 in the diaphragm 36 prevents the anisotropic conductive filler from passing through the openings 40. The anisotropic conductive filler 50 can include an epoxy medium (i.e., and epoxy base or carrier) and a plurality of conductive particles 54 which are distributed throughout the totality of the interstitial layer 50 and, in an embodiment, evenly distributed throughout the totality of the interstitial layer 50. The conductive particles form a z-axis conductor as described below, but the density of the conductive particles within the base is insufficient for conduction in the x-axis and the y-axis. The conductive particles can be dielectric spheres (for example ceramic, plastic, polymer, etc.) coated with a conductor such as metal, or can be a solid conductor such as metal. The conductive particles can also be metal flakes or unidirectional micro wires. The plurality of conductive particles 54 are electrically isolated from each other, and can have an average diameter of from about 1.0 micrometer (μm) to about 5.0 μm. The uncured interstitial layer 50 can have a relatively planar upper surface as depicted in FIG. 5 as a result of self-leveling, or the upper surface can be uneven at this processing stage.

Figure 6:
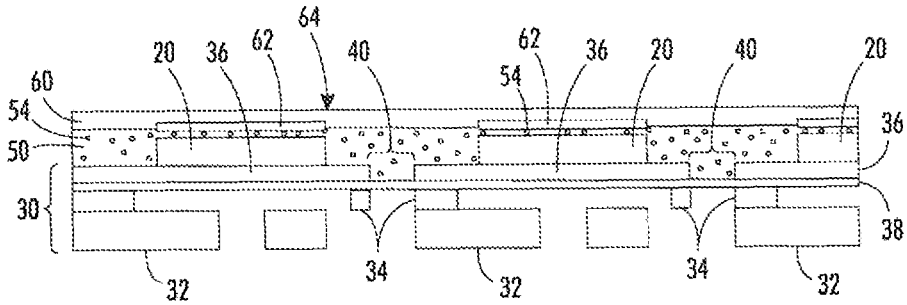

Subsequent to dispensing the anisotropic conductive filler 50, a flexible printed circuit (i.e., "flex circuit") 60 having a plurality of conductive elements (i.e., electrodes) 62 is attached to the exposed surface of the interstitial layer 50. The conductive elements 62 are aligned with the piezoelectric elements 20, and physical contact is made between the flex circuit 60 and the interstitial layer 50. A sufficient downward force is applied to the upper surface 64 of the flex circuit 60 during attachment of the flex circuit 60 to the interstitial layer 50 to ensure that some of the conductive particles 54 contact both the piezoelectric elements 20 and the conductive elements 62. In an embodiment, the downward force can be sufficient to deform the plurality of particles 54 which are interposed between the piezoelectric element 20 and the conductive element 62 as depicted in FIG. 6, thereby establishing electrical contact from the conductive element 62 and the piezoelectric element 20 through conductive particles 54. In another embodiment, the downward force is sufficient to establish electrical contact between the conductive element 62, the conductive particles 54, and the piezoelectric element 20, but is insufficient to deform the particles 54 such that the particles maintain their original shape. As known in the art, flex circuit 60 includes internal traces (not individually depicted) which electrically connect to each conductive element 62 to route an electric signal to the piezoelectric element 20. Through this internal routing, a voltage can be selectively applied to each conductive element 62 to activate each piezoelectric element 20 independent of the other conductive elements 62 and piezoelectric elements 20. An electrical pathway is established between each conductive element 62 and a piezoelectric element 20 through conductive particles 54 within the anisotropic conductive filler 50. More specifically, as described above, each piezoelectric element 20 can include a conductor such as a nickel layer over both the top and bottom surfaces, and electrical contact between each conductive element 62 and the conductor over the top surface of the piezoelectric element 20 is provided through conductive particles 54 within the anisotropic conductive filler 50. A nickel layer ensures that even if only one conductive particle 54 is trapped between the conductive element 62 and the piezoelectric element 20 attached thereto, a voltage can be applied to the entire top surface of the piezoelectric element 20 through the electrical pathway from the conductive element 62, to the conductive particle 54, and to the piezoelectric element 20. In another embodiment, the flex circuit 60 can instead be a printed circuit board (PCB).

Additionally, the application of force to the upper surface 64 of the flex circuit 60 levels the upper surface of the uncured interstitial layer 50. After the application of downward force, the interstitial layer is cured using a technique appropriate for the anisotropic conductive filler. Typically, this can include curing the material through the application of heat to remove volatile solvents within the interstitial layer 50. In another embodiment, the interstitial layer 50 can be cured using exposure to ultraviolet radiation. The interstitial layer 50 thus functions as an adhesive to physically attach the flex circuit 60 to the jet stack subassembly 30, and the conductive particles 54 dispersed therein function as a z-axis conductor to electrically coupled the piezoelectric elements 20 to the conductive elements 62.

Figure 7:
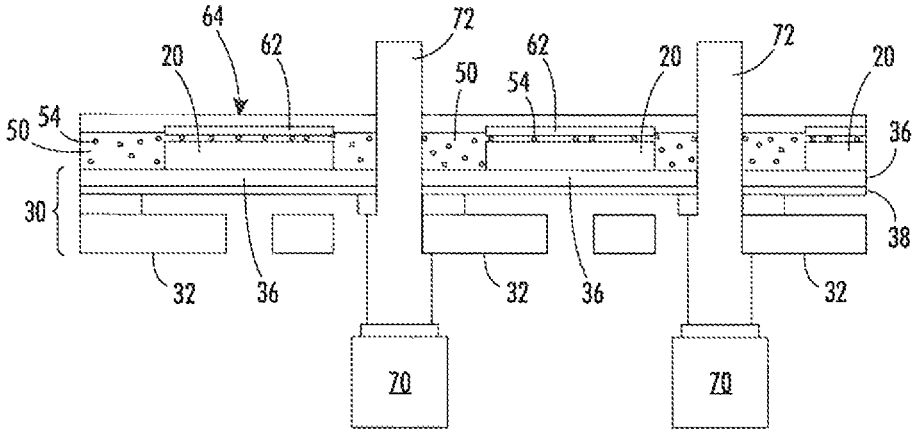

Next, the openings 40 through the diaphragm 36 can be cleared to allow passage of ink through the diaphragm 36. Clearing the openings 40 includes removing a portion of the adhesive diaphragm attach material 38, the interstitial layer 50, and the flex circuit 60 which cover the opening 40. In various embodiments, chemical or mechanical removal techniques can be used. In an embodiment, a self-aligned removal process can include the use of a laser 70 outputting a laser beam 72 as depicted in FIG. 7, particularly where the inlet/outlet plate 32, the body plate 34, and the diaphragm 36 are formed from metal. The inlet/outlet plate 32, the body plate 34 and optionally, depending on the design, the diaphragm 36 can mask the laser beam 72 for a self-aligned laser ablation process. In this embodiment, a laser such as a $CO_2$ laser, an excimer laser, a solid state laser, a copper vapor laser, and a fiber laser can be used. A $CO_2$ laser and an excimer laser can typically ablate polymers including epoxies. A $CO_2$ laser can have a low operating cost and a high manufacturing throughput. While two lasers 70 are depicted in FIG. 7, a single laser beam can open each hole in sequence using one or more laser pulses. In another embodiment, two or more openings can be made in a single operation. For example, a mask inserted in the image plane of an excimer laser could open two or more openings, or all of the openings, using one or more pulses from a single wide laser beam. A $CO_2$ laser beam that can over-fill the mask provided by the inlet/outlet plate 32, the body plate 34, and possibly the diaphragm 36 could sequentially illuminate each opening 40 to form the extended openings through the diaphragm attach material 38, the interstitial layer 50, and the flex circuit 60 as depicted in FIG. 7 to result in the FIG. 8 structure.

Figure 9:
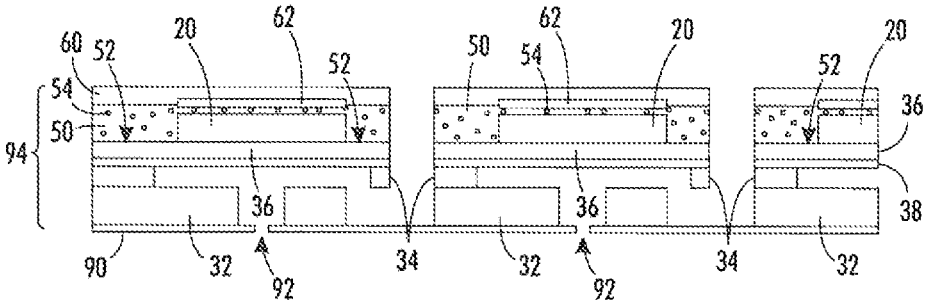

Subsequently, an aperture plate 90 can be attached to the inlet/outlet plate 32 with an adhesive (not individually depicted) as depicted in FIG. 9. The aperture plate 90 includes nozzles 92 through which ink is expelled during printing. Once the aperture plate 92 is attached, the jet stack 94 is complete.

Figure 10:
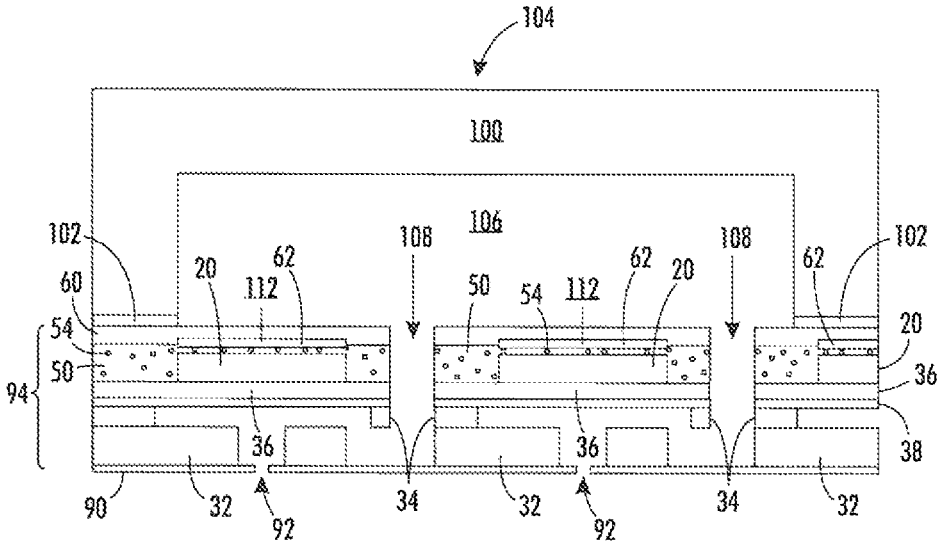
FIG. 10 is a cross section of a print head including the jet stack of FIG. 9.

Subsequently, a manifold 100 can be bonded to the flex circuit 60, for example using a fluid-tight sealed connection 102 such as an adhesive to result in an ink jet print head 104 as depicted in FIG. 10. The ink jet print head 104 can include a reservoir 106 formed by a surface of the manifold 100 and the flex circuit 60 for storing a volume of ink. Ink from the reservoir 106 is delivered through ports 108 in the jet stack 94. It will be understood that FIG. 10 is a simplified view, and may have additional structures to the left and right of the FIG. For example, while FIG. 10 depicts two ports 108, a typical jet stack can have, for example, a 344×20 array of ports.

In use, the reservoir 106 in the manifold 100 of the print head 104 includes a volume of ink. An initial priming of the print head can be employed to cause ink to flow from the reservoir 106, through the ports 108 in the jet stack 94, and into chambers 110 in the jet stack 94. Responsive to a voltage 112 placed on each conductive element 62, each PZT piezoelectric element 20 oscillates at an appropriate time in response to a digital signal. The oscillation of the piezoelectric element 20 causes the diaphragm 36 to flex which creates a pressure pulse within the chamber 110 causing a drop of ink to be expelled from the nozzle 94.

The methods and structure described above thereby form a jet stack 94 for an ink jet printer. In an embodiment, the jet stack 94 can be used as part of an ink jet print head 104 as depicted in FIG. 10.

Figure 11:
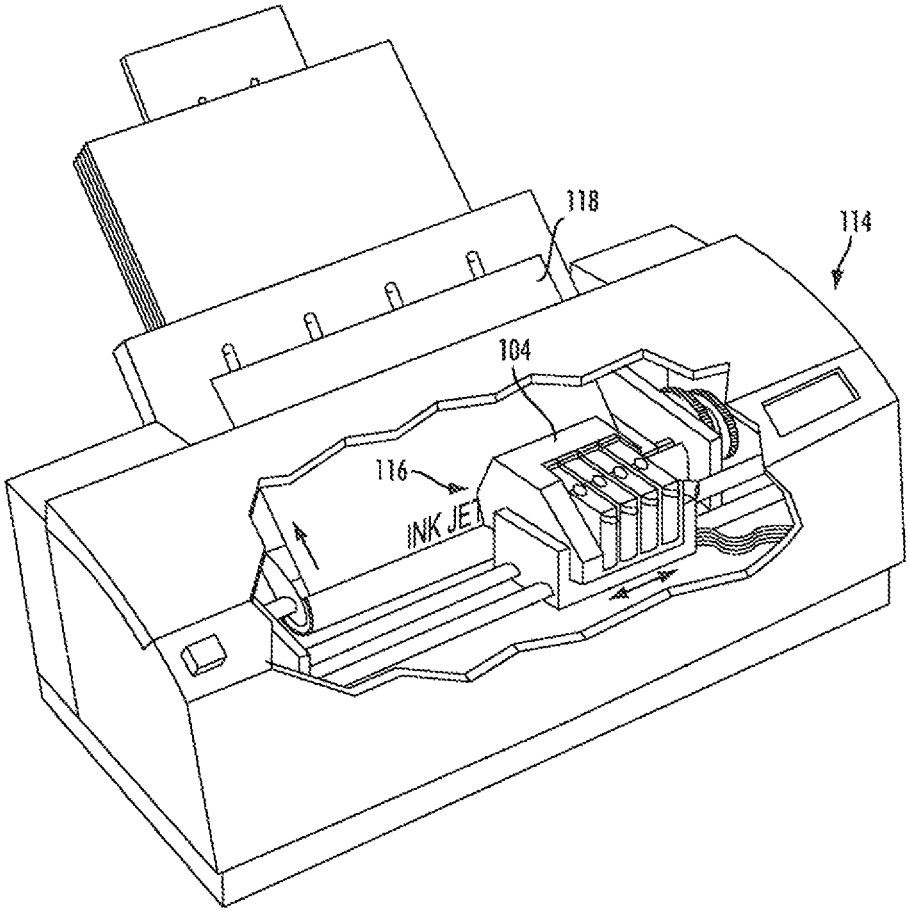
FIG. 11 is a printing device including a print head according to an embodiment of the present teachings.

FIG. 11 depicts a printer 114 including one or more print heads 104 and ink 116 being ejected from one or more nozzles 92 in accordance with an embodiment of the present teachings. Each print head 104 is operated in accordance with digital instructions to create a desired image on a print medium 118 such as a paper sheet, plastic, etc. Each print head 104 may move back and forth relative to the print medium 118 in a scanning motion to generate the printed image swath by swath. Alternately, the print head 104 may be held fixed and the print medium 118 moved relative to it, creating an image as wide as the print head 104 in a single pass. Additionally, printing can include using the print head 104 to form an ink pattern 116 on an intermediate heated structure (not individually depicted for simplicity) such as a drum, and using the drum to transfer (transfix) the image onto the print medium 118. The print head 104 can be narrower than, or as wide as, the print medium 118.

The embodiment described above can thus provide a jet stack for an ink jet print head which can be used in a printer. The method for forming the jet stack, and the completed jet stack, does not require the use of a standoff layer which provides large area adhesion to the polymer fill interstitial layer and the electrical interconnect. Additionally, the method does not require the removal of an interstitial layer from the top of each piezoelectric element. In this embodiment, the interstitial layer 50 includes conductive particles 54 which electrically couple each conductive element 60 to a piezoelectric element 20. Further, the interstitial layer 50 remains over the top of each piezoelectric element 20 during use of the device.

Figure 8:
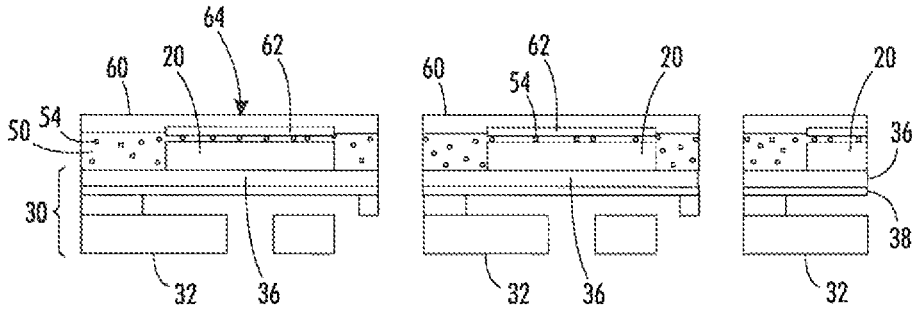

As depicted in FIGS. 7 and 8, laser ablation of the diaphragm attach material 38, the interstitial layer 50, and the flex circuit 60 can be performed to clear the opening 40 through the diaphragm 36. The resulting residue created during laser ablation can contain conductive particles 54 which may not be vaporized during laser ablation. In embodiments, any debris or residue resulting from this laser ablation is not a concern, or can be removed from the jet stack using, for example, a liquid rinse or an air blast to clean the residue.

Another embodiment of the present teachings is described below with reference to FIGS. 12-15, which does not result in free conductive particles 54 from laser ablation.

Figure 12:
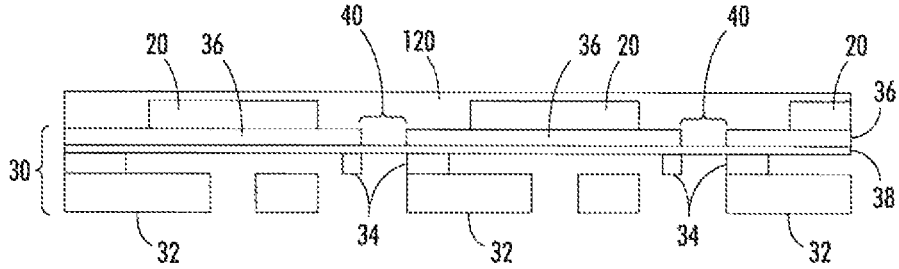
FIGS. 12-18 are cross sections of in-process structures depicting the formation of an ink jet print head including a jet stack according to another embodiment of the present teachings.

This embodiment can include the formation of a structure similar to that depicted in FIG. 4 using the method described above. After forming the FIG. 4 structure, an interstitial fill material is dispensed over the FIG. 4 structure to provide an interstitial layer 120 between each of the piezoelectric elements 20, and over the top surface of each piezoelectric element 20 as depicted in FIG. 12. In this embodiment, the interstitial fill material can include a dielectric epoxy or other polymer, such as a combination of Epon™ 828 epoxy resin (100 parts by weight) available from Miller-Stephenson Chemical Co. of Danbury, Conn. and Epikure™ 3277 curing agent (49 parts by weight) available from Hexion Specialty Chemicals of Columbus, Ohio. In an embodiment, the interstitial layer 120 over the top of the piezoelectric elements 20 can have a thickness of between about 5.0 μm and about 10.0 μm.

After depositing the interstitial layer 120, it can be partially cured, for example by heating the FIG. 12 structure to a temperature of between about 30° C. and about 100° C. for a duration of between about 1 minute and about 60 minutes. In another embodiment, the interstitial layer 120 can be partially cured by the application of ultraviolet light for a duration which is insufficient to fully cure the material. In another embodiment, partially curing the interstitial layer 120 at this point in the process is not necessary. The interstitial layer 120 can have a relatively planar upper surface as a result of self-leveling of the material, or it can have an uneven upper surface.

Figure 13:
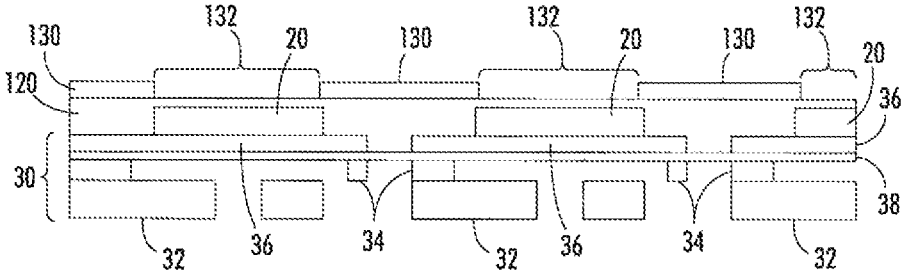

Next, a patterned mask 130 is formed over the surface of the FIG. 12 structure as depicted in FIG. 13. The patterned mask 130 includes openings 132 which expose the top surface of each piezoelectric element 20 as depicted. The patterned mask 130 can be formed using a stencil silkscreen, a preformed polyimide mask, a preformed metal mask, etc. If the upper surface of the interstitial layer 120 is relatively even, the patterned mask 130 can be a patterned photoresist layer formed using optical photolithography.

Figure 14:
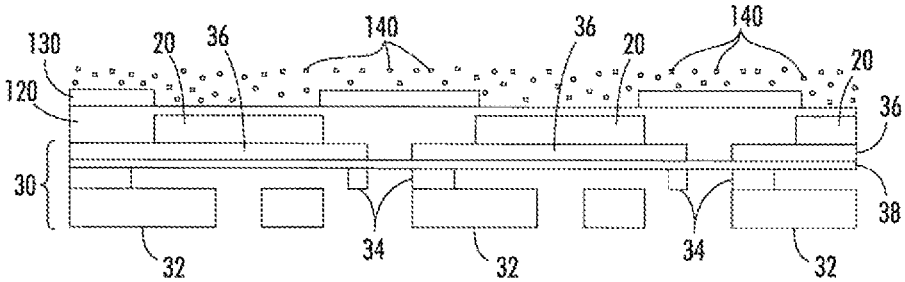

After application of the patterned mask, conductive particles 140 are applied to the FIG. 13 surface as depicted in FIG. 14. The conductive particles 140 can be loose particles which are sprayed, sprinkled, sputtered, or applied using another suitable technique. The particles can have an average diameter of between about 1.0 μm and about 10.0 μm, or about 3.0 μm and about 10.0 μm, or about 5.0 μm and about 10.0 μm. In an embodiment, the top surface of the patterned mask 130 can be adhesive or include an adhesive layer (not individually depicted) applied to the top surface of the mask which loose particles adhere to, such that the adhesive contains loose particles. Subsequent to applying the conductive particles 140, the patterned mask 130 is removed to form a structure similar to that depicted in FIG. 15.

Figure 15:
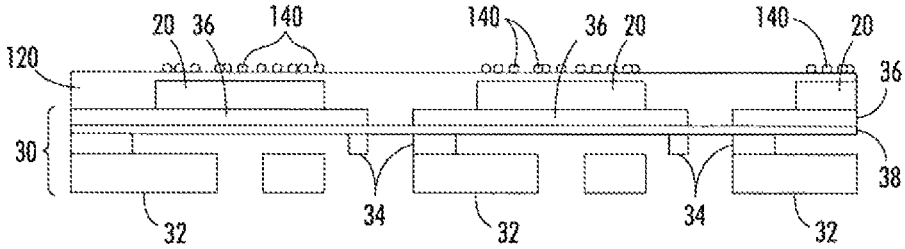
Figure 16:
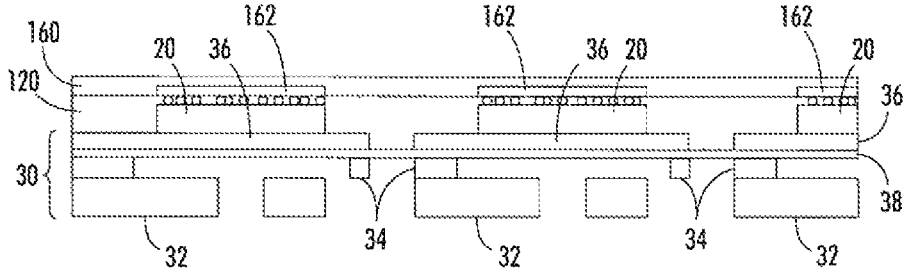

Next, a flex circuit 160 having a plurality of conductive elements 162 can be attached to the top surface of the FIG. 15 structure as depicted in FIG. 16. The attachment can include the use of a downward force which is sufficient to embed the conductive particles 140 into the interstitial layer 120 over the top of the piezoelectric elements 20. In this embodiment, the conductive particles are localized within the interstitial layer 120 over the top surface of each piezoelectric element 20. At locations other than over the top surface of each piezoelectric element 20, the interstitial layer 120 is devoid of conductive particles 140. The downward force is also sufficient to facilitate physical and electrical contact between the conductive particles 140 and the piezoelectric elements 20, and between the conductive particles 140 and the conductive elements 162 of the flex circuit 160. Thus an electrical pathway between the plurality of conductive elements 162 and the plurality of piezoelectric elements 20 is established through contact with the plurality of conductive particles 140. The downward force is further sufficient to level and planarize the upper surface of the interstitial layer 160, if leveling has not been previously established, for example, through self-leveling. The interstitial layer 120 functions as an adhesive to physically connect the flex circuit 160 to the jet stack subassembly 30, and the conductive particles 140 electrically couple the piezoelectric elements 20 to the conductive elements 162 of the flex circuit 160. As discussed above, the flex circuit 160 further includes conductive routings (not individually depicted) which provide an electrical connection to the conductive elements 162.

After forming the FIG. 16 structure, the interstitial layer 120 is cured using a technique appropriate for the material. Typically, this can include curing the material through the application of heat to remove volatile solvents within the interstitial layer 120. In another embodiment, the interstitial layer 120 is cured using exposure to ultraviolet radiation.

Figure 17:
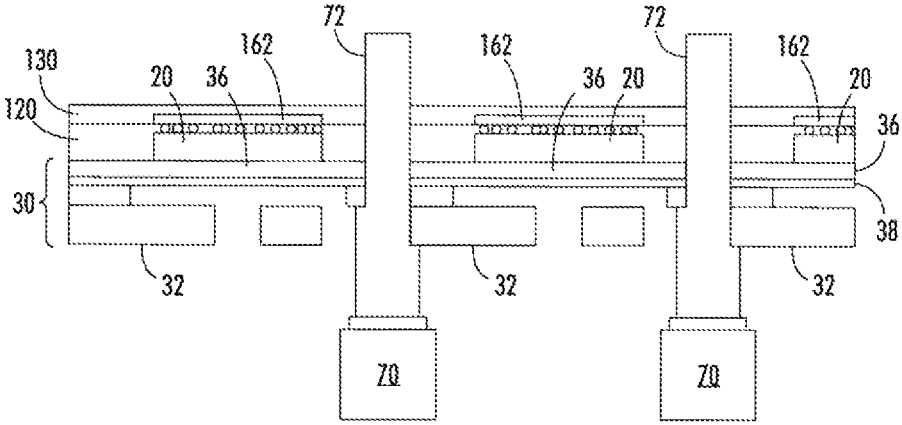
Figure 18:
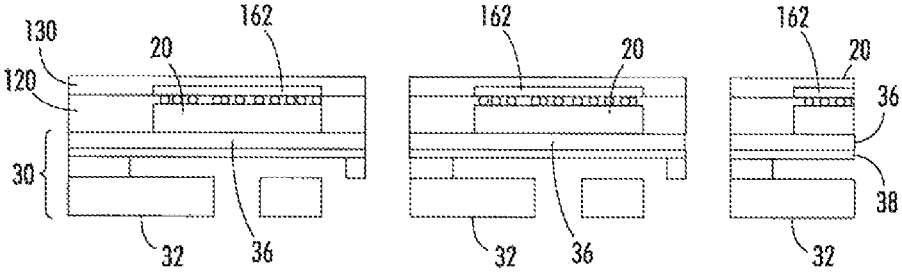

Subsequently, the openings 40 within the diaphragm 36 can be cleared to remove the diaphragm attach material 38, the interstitial layer 120, and the flex circuit 160 which covers the opening 40. The material can be cleared using a wet or dry chemical etch, mechanical techniques such as by drilling, or by using a laser 70 outputting a laser beam 72 as depicted in FIG. 17, similar to the method described above. After clearing the opening 40 within the diaphragm 36, the structure similar to that depicted in FIG. 18 remains. Processing can continue using a method similar to that depicted and described with reference to FIGS. 9 to 11 above.

In this embodiment, the laser ablation at FIG. 17 removes the diaphragm attach adhesive 38, the interstitial layer 120, and the flex circuit 160. The interstitial layer 120 which is ablated by the laser beam 72 does not contain conductive particles 140, thus loose conductive particles are not released from the interstitial layer 120.

Note that while the exemplary method is illustrated and described as a series of acts or events, it will be appreciated that the present invention is not limited by the illustrated ordering of such acts or events. For example, some acts may occur in different orders and/or concurrently with other acts or events apart from those illustrated and/or described herein, in accordance with the present teachings. In addition, not all illustrated steps may be required to implement a methodology in accordance with the present teachings. Other embodiments will become apparent to one of ordinary skill in the art from reference to the description and FIGS. herein.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g.—1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. An ink jet print head, comprising:

a diaphragm comprising a plurality of openings therethrough;

a body plate attached to the diaphragm with a diaphragm attach material;

a plurality of piezoelectric elements attached to the diaphragm;

an interstitial layer encapsulating the plurality of piezoelectric elements;

a plurality of conductive elements;

a plurality of conductive particles interposed between each conductive element and each piezoelectric element, wherein the plurality of conductive particles are dispersed within the interstitial layer, are electrically isolated from each other, and electrically couple the plurality of piezoelectric elements to the plurality of conductive elements.

2. The ink jet print head of claim 1, further comprising:

a plurality of conductive particles evenly distributed throughout the totality of the interstitial layer.

3. The ink jet print head of claim 1, further comprising:

the plurality of conductive particles are localized within the interstitial layer over the top surface of each piezoelectric element.

4. The ink jet print head of claim 1, wherein the plurality of conductive particles each have a diameter of between about 1.0 μm and about 5.0 μm.

5. The ink jet print head of claim 1, wherein a thickness of the interstitial layer over a top surface of each piezoelectric element is between about 5.0 μm and about 10.0 μm.

6. The ink jet print head of claim 1, further comprising:

a flex circuit which comprises the plurality of conductive elements;

at least one port for the passage of ink therethrough, wherein the port extends through an opening in the flex circuit, an opening in the interstitial layer, an opening in the diaphragm attach material, and an opening in the diaphragm.

* * * * *